US005108880A

United States Patent [19]

Adkins

[11] Patent Number: 5,108,880

[45] Date of Patent: Apr. 28, 1992

[54] DEVELOPER COMPOSITION FOR SILVER HALIDE PHOTOGRAPHIC MATERIAL

[75] Inventor: John L. Adkins, Clark, N.J.

[73] Assignee: Sun Chemical Corporation, Fort Lee, N.J.

[21] Appl. No.: 630,667

[22] Filed: Dec. 20, 1990

[51] Int. Cl.[5] ..... G03C 5/30

[52] U.S. Cl. ..... 430/487; 430/264; 430/448; 430/484; 430/485; 430/486; 430/490

[58] Field of Search ..... 430/264, 448, 464, 467, 430/484, 485, 486, 487, 490, 566; 252/544, 548; 564/475, 505

[56] References Cited

U.S. PATENT DOCUMENTS 4,269,929 5/1981 Nothnagle ..... 430/264
4,740,452 4/1988 Okutsu et al. ..... 430/439
4,755,448 7/1988 Katoh ..... 430/264
4,863,830 9/1989 Okutsu et al. ..... 430/264
4,975,354 12/1990 Machonkin et al. ..... 430/264

*Primary Examiner*—Hoa Van Le
*Attorney, Agent, or Firm*—Jack Matalon

[57] ABSTRACT

A water soluble alkaline developer composition useful in the development of exposed silver halide photographic material comprised of a developing agent, a sulfite preservative and a small but effective amount of an amino alcohol compound of the formula

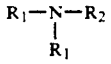

wherein each $R_1$ is a $C_2$-$C_4$ alkyl group and $R_2$ is a moiety having the structure: $(R_1O)_x$—$R_1OH$ wherein x is an integer of from 1 to 3, and $R_1$ is as defined hereinabove.

5 Claims, No Drawings

DEVELOPER COMPOSITION FOR SILVER HALIDE PHOTOGRAPHIC MATERIAL

The present invention relates to a developer composition for contrast development of a silver halide photographic material, and in particular, to a process for preparing a negative image of high contrast which is especially suitable to a photomechanical process for printing of graphic arts.

BACKGROUND OF THE INVENTION

In the field of graphic arts, an image formation system capable of giving a photographic characteristic of high contrast is required, enough to attain a good regeneration of a dot image of continuous gradation as well as a good regeneration of a line image.

A specific developer called a lith-developer has heretofore been used for the purpose. The lith-developer contains only hydroquinone as a developing agent, and uses a sulfite preservative in the form of an adduct of a sulfite with formaldehyde in order to keep extremely low concentration of the free sulfite ion in the developer, whereby the infectious developability is not deteriorated. Thus, the lith-developer is extremely easily oxidized with air and difficult to withstand a preservation of over three days, which is a serious defect.

Methods for obtaining a photographic characteristic of high contrast by the use of a stable developer are disclosed in U.S. Pat. Nos. 4,224,401, 4,168,977, 4,166,742, 4,311,781, 4,272,606, 4,211,857, and 4,243,739, where a hydrazine derivative is used. According to the methods, a photographic characteristic of high contrast and high sensitivity may be obtained, and moreover, addition of a sulfite of high concentration to a developer is possible. Accordingly, the stability of the developer against air-oxidation is markedly improved, as compared with the lith-developer.

In the methods using a hydrazine derivative, however, the pH value of the developer is kept higher than that of a conventional lith-developer, and therefore, the pH value of the developer is variable, resulting in a variation of the developed photographic characteristics. This is a troublesome problem.

U.S. Pat. No. 4,269,929 discloses, in order to solve said problem to use an alkaline developer containing a dihydroxy-benzene developing agent and a 3-pyrazolidone developing agent, to which an amine compound is added so as to improve the activity of the developer; whereby the hydrazine derivative exerts effects of sensitization and producing high contrast image by the developer having a lower pH value.

It is impossible, however, to sufficiently lower the pH value of the developer enough to stop the variation of the pH value under the condition of a general preservation or use, even by the method.

In addition, the amino compounds added to the developer act as a solvent of a silver halide (refer to The Theory of the Photographic Process, 3rd Ed., p. 370, written by C. E. K. Mees, and Photographic Processing Chemistry, p.43, written by L. F. A. Mason). Under the circumstances, the method for the development using a large amount of amino compounds as disclosed in the U. S. patent has a problem of a so-called "silver stain". The "silver stain" is a defective phenomenon which occurs during development by a transfer of silver, which is depositioned or precipitated on the surface of a wall of the development tank or of a roller of a film conveyor from a silver halide dissolved in a developer, to a fresh film to be newly developed, wherein the developer is used in a development method using an automatic developing apparatus where a supplementary developer solution is fed into a development tank, in accordance with the area of the film to be developed and, the developer in the tank is used for a long period of time.

U.S. Pat. No. 4,740,452 also discloses an alkaline developer composition containing a developing agent, a preservative and an amino compound taught to avoid the staining problems of the prior art processes and products. However, this prior art composition must be employed at a relatively high pH which causes stability problems in the employment of the developer composition.

In order to overcome both the silver stain and instability problems encountered in the use of the prior art developer compositions, we have discovered the instant developer composition to be eminently successful.

SUMMARY OF THE INVENTION

The object of the present invention is therefore to provide a process for preparing a negative image of high contrast preferably having a y value of 10 or more in the presence of a hydrazine derivative, to obtain a photographic film image with less silver stain.

Accordingly, the present invention provides a novel process for preparing a negative image of high contrast by developing an exposed silver halide photographic material which is a surface latent image-type material in the presence of a hydrazine derivative, characterized in that the material is processed with a water-soluble alkaline developer having a pH value of from 10.5 to 12.3 and at least comprising the following components (1) through (3):

(1) a developing agent;

(2) a sulfite preservative and (3) a small but effective amount of an amino alcohol of formula (A).

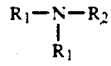

(A)

wherein each $R_1$ is an alkyl group having from 2 to 4 carbon atoms; and $R_2$ is a moiety of the formula:

$$(R_1—O)_x—R_1OH$$

wherein $R_1$ is as hereinbefore defined, and x is an integer of from 1 to 3.

DETAILED DESCRIPTION OF THE INVENTION

The process for preparing images of the present invention preferably uses a developing composition comprised of a developing agent, a preservative and the amino compound of formula A above.

The developing agents which may be employed in the practice of this invention include those that are taught and disclosed to be useful for such purposes in U.S. Pat. Nos. 4,269,929 and 4,740,452. These developing agents include dihydroxybenzene-type developing agents; or aryl-pyrazolidine developing agents such as phenyl-pyrazolidone agents or aminophenyl-type developing agents.

Examples of dihydroxybenzene-type developing agents which may be used in the present invention include hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, etc.; and hydroquinone is especially preferred among them.

Examples of 1-phenyl-3-pyrazolidone or derivatives thereof which may be used as developing agents are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

Examples of p-aminophenyl-type developing agents are N-methyl-p-minophenol, p-amino-phenol, N-$\beta$-hydroxyethyl-p-aminopheno, N-(4-hydroxyphenyl)glycine, 2-methyl-p-aminophenol, p-benzyl-aminophenol, etc.; and N-methyl-p-aminophenol is especially preferred among them.

The dihydroxybenzene-type developing agent is in general used preferably in an amount of from 0.05 mole to 0.8 mole, more preferably from 0.2 mole to 0.6 mole per liter of the developer. In case of a combination comprising dihydroxybenzenes and 1-phenyl-3-pyrazolidones or a p-aminophenols is used, the amount of the former to be used is preferably from 0.05 mole to 0.5 mole, and the amount of the latter to be used is preferably 0.06 mole or less, more preferably 0.03 mole or less, per liter of the developer.

The preservative agents which may be employed in the practice of this invention include those which are taught and disclosed in U.S. Pat. Nos. 4,269,929 and 4,740,452, and include such preservative agents as sulfite preservatives.

Examples of sulfite preservatives to be used in the present invention are sodium sulfite, potassium sulfite, lithium sulfite, sodium bisulfite, potassium meta-bisulfite, formaldehyde-sodium bisulfite, etc. The amount of sulfite to be used is 0.3 mole/liter or more, more preferably 0.4 mole or more per liter of the developer. Excessive addition of the sulfite to a developer, however, causes to precipitate in the developer, resulting in staining of the developer solution, and therefore, the upper limit of the amount is preferably 1.2 mole/liter, more preferably 1.0 mole per liter of the developer.

The amino alcohols which are useful in the practice of this invention act as contrast promoters in the production of the negatives obtained from the developed film. These amino alcohols have the structure of:

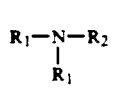

(A)

wherein the $R_1$ groups may be the same or different and each is an alkyl group having from 2 to 4 carbon atoms, and most preferably from 2 to 3 carbon atoms; and $R_2$ is a moiety of the formula $(R_1—O)_x—R_1OH$ wherein $R_1$ is as hereinbefore defined, and x is an integer of from 1 to 3.

Examples of the amino alcohols of formula (A) are diethylaminoethoxyethoxyethanol; diethylaminoethoxyethanol; dipropylaminoethoxyethanol; diethyl aminopropoxyethanol; diethyl aminobutoxyethanol; and other like compounds which are known to the skilled worker seeking to practice this invention. The preferred amino alcohol is diethylaminoethoxyethoxyethanol.

The amino alcohols represented by formula (A), being different from any other amino compounds, have excellent characteristics in that these remarkably accelerate the high contrast of the formed images, even though these are used in a small amount and on the other hand, these have a weak action to silver halides as a solvent and these do not cause any silver stain in the developed photographic materials.

The amino alcohol of formula (A) is used in an amount of from 0.01 to 0.30 mole, most preferably from 0.01 to 0.2, mole per liter of the developer composition.

The developer composition of the present invention may further contain, in addition to the above-described components, a pH buffer such as boric acid, borax, sodium tert-phosphate, or potassium tert-phosphate; a development inhibitor such as potassium bromide or potassium iodide; an organic solvent such as ethyleneglycol, diethyleneglycol, triethyleneglycol, dimethylformamide, methylcellosolve, hexyleneglycol, ethanol, or methanol; an anti-fogging agent or a black pepper-inhibitor such as indazole compound (e.g., 5-nitroindazole) or a benzotriazole compound (e.g., 5-methylbenzotriazole), etc. in case that 5-nitroindazole or the like compound is to be used, the compound is previously dissolved in a separate solution, apart from the main solution containing a dihydroxybenzene-type developing agent and a sulfite preservative, and the two solutions are blended and water is added thereto, at the time of the actual use of the developer, which is a general means. In this case, the 5-nitroindazole-containing solutions is preferably made alkaline thereby to be colored in yellow, and thus, the colored solution may easily be handled in an actual photographic operation.

In addition, the developer composition of the present invention may further contain, if necessary, a toning agent, a surfactant, a water-softener, a hardener, etc.

As a fixing solution, any conventional ones may be used. As a fixing agent may be used a thiosulfate and a thiocyanate, and in addition, any other organic sulfur compounds which are known to be effective as a fixing agent may also be used. As an oxidizing agent may be used ethylenediamine-tetraacetate-iron (III) complex.

The temperature upon development treatment is selected in general from the range of from 18° C. to 50° C., but the temperature may optionally be lower than 18° C. or may optionally be higher than 50° C.

The process of the present invention is especially suitable for a rapid treatment using an automatic development apparatus. The automatic development apparatus may be any type of a roller conveyance system, a belt conveyance system, or other system. The treatment time may be short, totalling 2 minutes or less, especially 100 seconds or less, and among them, the time allotted for the development may be from 15 to 60 seconds. The developer composition of the present invention may sufficiently attain the effect even in such rapid development.

The hydrazine derivatives which may be used in the practice of the instant invention may be those which are taught and disclosed in U.S. Pat. Nos. 4,269,929 and 4,740,452, as well as the manner of their use which is also disclosed in said U.S. Pat. Nos. 4,269,929, 4,740,452 and 4,863,830.

The silver halide-photographic materials to which the method for image-formation and the developer composition of the instant invention are applied are also described in U.S. Pat. Nos. 4,269,929 and 4,740,452.

The present invention will be explained in greater detail by reference to the following examples which, however, are not intended to be interpreted as limiting the scope of the present invention.

EXAMPLE 1

Developer compositions of the following formulae were prepared:

TABLE 1

| Developer | Amounts | |
|---|---|---|
| Tetra-sodium ethylenediamine-tetraacetate | 1.0 g | 1.0 g |
| Sodium hydroxide | 9.0 g | 9.0 g |
| Potassium tert-phosphate | 74.0 g | 74.0 g |
| Potassium sulfite | 90.0 g | 90.0 g |
| 5-Methylbenzotriazole | 0.5 g | 0.5 g |
| Sodium bromide | 3.0 g | 3.0 g |
| p-Aminophenol $\frac{1}{2}H_2SO_4$ | 1.0 g | 1.0 g |
| Hydroquinone | 1.0 g | 1.0 g |
| Diethyl aminoethoxyethoxyethanol | 5.0 g | — |
| 6-Diethylamino-1-hexanol | — | 5.0 g |
| pH | 11.6 | 11.6 |
| All components were dissolved in water to form a concentrated solution having a volume of 500 ml in total. | Dissolved | Not Dissolved |
| All components were dissolved in water to form a developer solution ready for use, having a volume of one liter total. | Dissolved | Not Dissolved |

EXAMPLE 2

The developer composition of Example 1 was attempted to be prepared in accordance with the teachings thereof except that an equivalent amount of each of 6-Diethylamino-1-hexanol and 8-Diethylamino-1-octanol was substituted for the Diethylaminoethoxy. ethoxyethanol. Neither of the substitute compounds were soluble in either the diluted developer solution or in water and therefore they were unusable in the practice of the instant invention.

EXAMPLE 3

The developer compositions of Example 1 were used to develop exposed silver halide photographic film having a hydrazine derivative incorporated therein prepared in accordance with the teachings of Example 1 of U.S. Pat. No. 4,740,452 with the following results:

TABLE 2

| Sample No. | Developer* | Results |
|---|---|---|
| 1 | A | Good |
| 2 | A | Good |
| 3 | A | Good |

*From Example 1 above

While the invention has been described in detail and with reference to specific embodiments thereof, it will be apparent to one skilled in the art that various changes and modifications can be made therein without departing from the spirit and scope thereof.

What is claimed is:

1. A water-soluble alkaline developer composition useful for the development of exposed silver halide photographic material in the presence of a hydrazine derivative which comprises a) a developing agent; and b) a sulfite preservative; and c) an amino alcohol of the formula

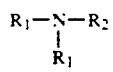

wherein each $R_1$ is the same or different and is an alkyl group containing 2 to 4 carbon atoms; and $R_2$ is a moiety of the formula $(R_1—O)_x—R_2OH$ wherein $R_1$ is as hereinabove defined, and x is an integer of from 1 to 3.

2. The developer of claim 1 wherein $R_1$ is $C_2H_5$ and x is 1 or 2.

3. The developer of claim 1 wherein $R_1$ is $C_2H_5$ and x is 2.

4. The developer of claim 1 wherein the amino alcohol is diethylaminoethoxyethoxyethanol.

5. The developer composition of claim 1 wherein the amino alcohol is present in an amount of 0.01 to 0.30 mole, per liter of developer composition.

* * * * *